US010544784B2

(12) United States Patent
Meinig

(10) Patent No.: US 10,544,784 B2
(45) Date of Patent: Jan. 28, 2020

(54) PUMP COMPRISING AN ADJUSTING DEVICE AND A CONTROL VALVE FOR ADJUSTING THE DELIVERY VOLUME OF THE PUMP

(71) Applicant: Schwäbische Hüttenwerke Automotive GmbH, Aalen-Wasseralfingen (DE)

(72) Inventor: Uwe Meinig, Bad Saulgau (DE)

(73) Assignee: Schwäbische Hüttenwerke Automotive GmbH, Aalen-Wasseralfingen (DE)

( * ) Notice: Subject to any disclaimer, the term of this patent is extended or adjusted under 35 U.S.C. 154(b) by 181 days.

(21) Appl. No.: 15/175,235

(22) Filed: Jun. 7, 2016

(65) Prior Publication Data

US 2016/0363120 A1 Dec. 15, 2016

(30) Foreign Application Priority Data

Jun. 10, 2015 (DE) ..... 10 2015 109 156

(51) Int. Cl.
*F04C 14/24* (2006.01)
*F04C 14/26* (2006.01)
(Continued)

(52) U.S. Cl.
CPC ..... *F04C 14/18* (2013.01); *F01C 21/108* (2013.01); *F04C 2/344* (2013.01); *F04C 14/185* (2013.01);
(Continued)

(58) Field of Classification Search
CPC ..... F04C 14/26; F04C 14/22; F04C 14/226; F04C 15/36; F04C 2/3442; F04C 14/223; F04C 14/18; F04C 14/24
(Continued)

(56) References Cited

U.S. PATENT DOCUMENTS 3,433,169 A * 3/1969 Graetz ..... F01C 21/0836 418/263
5,518,380 A * 5/1996 Fujii ..... F04C 14/226 418/26
(Continued)

FOREIGN PATENT DOCUMENTS

DE 36 30 792 A1 3/1987
DE 101 28 867 A1 12/2002
(Continued)

OTHER PUBLICATIONS

Extended European Search Report issued in EP 16 17 3190 dated Oct. 26, 2016 (13 pages).
(Continued)

*Primary Examiner* — Deming Wan
(74) *Attorney, Agent, or Firm* — RatnerPrestia

(57) ABSTRACT

A pump including a port connecting a suction of the pump to a reservoir of a fluid; region an adjusting device for adjusting the delivery volume of the pump; a control valve, including a relief port, a control piston, and a tensing device which acts on the control piston; and an additional control device for generating a control force which acts on the control piston, counter to the tensing device, wherein the relief port is connected to the suction region by bypassing the reservoir.

17 Claims, 5 Drawing Sheets

(51) Int. Cl.

| | |
|---|---|
| ***F04C 14/22*** | (2006.01) |
| ***F04C 2/344*** | (2006.01) |
| ***F04C 14/18*** | (2006.01) |
| ***F01C 21/10*** | (2006.01) |
| ***F04C 15/06*** | (2006.01) |

(52) U.S. Cl.
CPC ..... *F04C 14/223* (2013.01); *F04C 14/24* (2013.01); *F04C 15/06* (2013.01); *F04C 2240/20* (2013.01); *F04C 2240/30* (2013.01)

(58) Field of Classification Search
USPC ..... 418/24–26, 160, 27, 30, 135, 263, 266; 417/213, 220
See application file for complete search history.

(56) References Cited

U.S. PATENT DOCUMENTS

| | | | | |
|---|---|---|---|---|
| 5,876,185 | A | 3/1999 | Schimpf et al. | |
| 6,442,934 | B1 | 9/2002 | Okuda et al. | |
| 9,388,804 | B2 * | 7/2016 | Williamson | F01M 1/16 |
| 2005/0142006 | A1 | 6/2005 | Voigt | |
| 2009/0081052 | A1 * | 3/2009 | Soeda | F04C 2/3442 417/213 |
| 2010/0028171 | A1 | 2/2010 | Shulver et al. | |
| 2012/0204818 | A1 | 8/2012 | Welte et al. | |
| 2013/0121867 | A1 | 5/2013 | Ebinger et al. | |
| 2013/0209302 | A1 * | 8/2013 | Ono | F04C 2/102 418/17 |
| 2013/0251571 | A1 * | 9/2013 | Iijima | F04C 2/00 418/28 |
| 2014/0161645 | A1 | 6/2014 | Bohner et al. | |
| 2014/0199199 | A1 | 7/2014 | Meinig | |
| 2015/0044083 | A1 | 2/2015 | Akatsuka et al. | |
| 2017/0167484 | A1 * | 6/2017 | Peters | F04C 14/223 |

FOREIGN PATENT DOCUMENTS

| | | | |
|---|---|---|---|
| DE | 10 2012 200 173 | A1 | 7/2013 |
| EP | 2743506 | A2 | 6/2014 |
| EP | 2754896 | A1 | 7/2014 |
| WO | 2008037070 | A1 | 4/2008 |
| WO | WO 2008/037070 | A1 | 4/2008 |

OTHER PUBLICATIONS

German Office Action issued in German Patent Application No. 10 2015 109 156.9 dated Feb. 2, 2016.

First Office Action issued in Chinese Patent Application No. 201610420845.5 dated Jan. 3, 2018, 15 pages.

* cited by examiner

PUMP COMPRISING AN ADJUSTING DEVICE AND A CONTROL VALVE FOR ADJUSTING THE DELIVERY VOLUME OF THE PUMP

CROSS REFERENCE TO RELATED APPLICATIONS

This application claims priority to German Patent Application No. 10 2015 109 156.9, filed Jun. 10, 2015, the contents of such application being incorporated by reference herein.

FIELD OF THE INVENTION

The invention relates to a pump comprising an adjusting device and a control valve for adjusting the delivery volume of the pump. In particular, the invention relates to a pump which comprises an adjusting device for adjusting the specific delivery volume of the pump. The control valve is fluidically connected to the adjusting device, in order to be able to adjust the delivery volume of the pump by applying a pressurised setting fluid to the adjusting device. The pump can in particular be used to supply an assembly of a vehicle, such as for example a motor vehicle, with lubricating oil, a working fluid or a cooling fluid. The pump is expediently a displacement pump, but can in principle also be embodied as a fluid-flow machine. In preferred applications, the pump is used as a lubricating oil pump for supplying an internal combustion engine of a vehicle with lubricating oil, i.e. it is an engine lubricating oil pump.

BACKGROUND OF THE INVENTION

In accordance with a common design in engine lubricating oil pumps, the oil delivered by the pump, i.e. the oil from the high-pressure side of the oil circulation supplied by the pump, is applied to an adjusting member which is used to influence the delivery volume, such as for example a setting ring which can be pivoted. In this way, the delivery volume flow is limited when a particular pressure threshold is reached. Depending on the ancillary constraints of the engine, such as for example the rotational speed of the engine, the temperature of the engine, the need to cool pistons and so forth, an adjustment of the delivery volume—preferably, the specific delivery volume—is often implemented in the form of two or as applicable even more pressure stages, wherein it is alternatively or additionally possible to regulate the pump in accordance with an engine characteristic map, i.e. to perform characteristic-map regulation. In simple cases, pressure can be directly applied to the adjusting member using a manifold valve which is actuated by the engine controller. If the manifold valve cannot be arranged in a housing of the pump or near enough to the pump and/or if, for design reasons, the flow cross-sections in the valve or on the route to or from the valve cannot be dimensioned so as to be sufficient for rapid adjustment, a pilot valve can be provided which controls the application of pressure to or relief of pressure on the adjusting member which can commonly be moved counter to the force of a spring. In such embodiments, a pressure which acts on a partial surface of a pilot piston of the pilot valve, which is typically embodied as a stepped piston, is modulated using the electromagnetically actuated manifold valve.

A pump comprising a pilot valve and additionally an electromagnetic manifold valve is known from each of DE 36 30 792 A1, US 2005/0142006 A1, U.S. Pat. No. 5,876,185 A and WO 2008/037070 A1, which are incorporated by reference. The pilot valve connects the adjusting device, which comprises the adjusting member of the respective pump, with optionally either the high-pressure side of the respective pump circulation or a reservoir for the fluid delivered by the pump or separates the adjusting device from both the high-pressure side and the reservoir. In order to connect the adjusting device to the reservoir via the pilot valve and thus switch to ambient pressure, i.e. an absence of a pressure burden, the pressure fluid is either drained via the pilot valve directly into the environment and flows freely, due to gravity, into the reservoir which is positioned correspondingly low, or has to be guided to the reservoir via a feedback conduit to be provided especially. If it flows off freely, components—for example, components of a vehicle engine—situated in the vicinity of the pilot valve will become contaminated. The fluid flowing off will additionally also become contaminated. On the other hand, the additionally provided feedback conduit leads to an increase in cost. In both cases, aerated fluid is introduced into the reservoir and energy is dissipated needlessly.

SUMMARY OF THE INVENTION

An aspect of the invention provides a pump which can be adjusted in terms of its delivery volume by means of an adjusting device and control valve and which is an improvement in relation to relieving pressure on the adjusting device. A setting fluid which flows through the control valve in order to relieve pressure on the adjusting device is to be derived energy-efficiently, cleanly and cost-effectively.

The invention proceeds from a pump which exhibits an adjustable delivery volume and comprises: a pump housing comprising a delivery chamber; a delivery member which can be moved within the delivery chamber; an adjusting device for adjusting the delivery volume of the pump; a control valve for applying a control fluid to the adjusting device in a controlled way; and an additional control device for influencing the control valve. The delivery chamber comprises a delivery chamber inlet on a low-pressure side, and a delivery chamber outlet on a high-pressure side, for a fluid to be delivered by means of the delivery member. The pump housing comprises: a pump port for connecting the pump to a reservoir for the fluid; and a suction region through which the fluid on the low-pressure side of the pump can flow. The suction region extends from the pump port up to at least an inlet of the delivery chamber. If the transition from the lower pressure to the higher pressure occurs within the delivery chamber, as is in particular the case with rotary pumps, the suction region extends up to and into the delivery chamber but terminates on the low-pressure side of the delivery chamber.

If the pump is arranged in a pump circulation, the low-pressure side of the pump extends from a reservoir, from which the pump suctions the fluid, up to at least the delivery chamber inlet via the pump port. If the transition from low pressure to high pressure occurs within the delivery chamber, the low-pressure side of the pump also comprises the low-pressure side of the delivery chamber, i.e. extends on the low-pressure side up to and into the delivery chamber. The high-pressure side of the pump comprises the high-pressure region extending within the pump housing, and also extends up to at least the assembly to be supplied with the fluid or, if the pump supplies multiple assemblies with the fluid, up to each of these assemblies. Unlike the terms "low-pressure side" and "high-pressure side", the term "suction region" denotes a flow region extending only within the pump housing on the low-pressure side of the pump. On the other hand, the term "suction region" is not to be interpreted such that the pump in accordance with the invention has to suction the fluid from the reservoir against gravity. The pump can also be arranged at a point in its delivery cycle which is lower than the reservoir, such that the pump suctions the fluid with the assistance of gravity.

The pump can also be pre-loaded, i.e. a pre-loading pump can be connected upstream of the pump.

The control valve comprises: a pressure port for a setting fluid which is diverted from the fluid of the high-pressure side of the pump; a working port for the setting fluid, which is connected to the adjusting device; and a relief port for the setting fluid. The control valve also comprises: a control piston which can be moved back and forth within a valve space of the control valve between a first piston position and a second piston position; and a tensing device for generating a tensing force which acts on the control piston in the direction of one of the piston positions. The tensing device can comprise one or more springs for generating the tensing force. The tensing device can in particular be formed by a pressurised helical spring arranged in the valve space.

The additional control device is used to generate a control force which acts on the control piston of the control valve, counter to the tensing device. In order to generate the control force, the additional control device can comprise a control chamber which is closed on an end-facing side by the control piston and which comprises an inlet for a control fluid for generating a control fluid pressure which acts on the control piston, counter to the tensing force. The control fluid can be fluid diverted from the high-pressure side of the pump, but can in principle also be a different fluid and/or can be pressurised in a different way, for example by means of a different pump. Instead of generating the control force by means of a control fluid, or in addition to a fluidic control force, the control force can however also be an electromagnetically generated force or can comprise such a force component. In such embodiments, the additional control device comprises an electrical coil and an anchor which can be moved back and forth relative to the coil and which acts on the control piston, counter to the tensing force of the tensing device. In preferred embodiments, however, the control force is generated fluidically by means of a control fluid.

The valve piston and the valve ports are arranged such that the working port is connected to the pressure port when the control piston assumes the first piston position, and the working port is separated from the pressure port and connected to the relief port when the control piston assumes the second piston position. The control valve can also be configured such that the control piston can assume a third piston position, and the working port is separated from both the pressure port and the relief port when the control piston assumes the third piston position. The third piston position can in particular be an intermediate position which the control piston can assume in a movement direction between the first piston position and second piston position. The first piston position or instead the second piston position of the optionally three different piston positions can however in principle also be the intermediate position. Embodiments in which the control valve does not completely separate the working port from both the pressure port and the relief port in any piston position, but rather either separates the working port from the pressure port only and permits a comparatively small flow between the working port and the relief port, or separates the working port from the relief port and simultaneously permits a comparatively small flow between the working port and the pressure port, are also possible.

If the control valve is arranged outside the suction region of the pump housing, the fluid can flow through the suction region with little resistance, since the flow in the suction region is not impeded by the control valve. In preferred embodiments, the control valve is arranged not only outside the suction region but rather outside the main flow through the pump housing. In the preferred embodiments, the control valve therefore also does not impede the fluid from flowing off on the high-pressure side of the pump housing.

If the pump is arranged in a fluid delivery cycle, the control valve is arranged outside the main flow of the delivery cycle in a secondary flow arm in preferred embodiments. The control valve can thus be embodied independently of the requirement for a low-resistance main flow. The control valve can be dimensioned to be correspondingly small and specifically optimised for performing its function of controlling the setting fluid for the adjusting device. The main flow of the delivery cycle extends on the low-pressure side of the pump from the reservoir up to and into the pump housing and comprises the suction region of the pump housing. On the high-pressure side, the main flow comprises: the high-pressure region of the pump housing, through which the fluid flows from the delivery chamber up to and including an outlet of the pump housing; and the adjoining high-pressure region outside the pump housing up to at least an assembly to be supplied with the fluid by the pump. If the pump supplies multiple assemblies, the main flow is understood to be the flow to the assembly which has the highest volume requirement, measured as a volumetric flow rate, or which has to be supplied with the highest pressure.

In accordance with the invention, the relief port is connected to the suction region of the pump by bypassing the reservoir. Setting fluid flowing off from the control valve through the relief port is fed back into the fluid delivery cycle of the pump in a relief channel downstream of the reservoir. The setting fluid flowing off from the control valve through the relief port can be fed back into the main flow at a connecting point between the reservoir and the pump housing, wherein such a connecting point is preferably nearer the pump housing than the reservoir. The relief channel extends from the relief port up to the connecting point with the main flow. In accordance with the invention, the control valve is not in fluid communication with the reservoir via the relief port. No fluid flows from the reservoir into the valve space of the control valve via the relief port, and in particular no fluid flows from the control valve to the reservoir via the relief port.

In preferred embodiments, the setting fluid is fed directly back into the suction region of the pump housing. In such embodiments, the relief channel feeds into the suction region, i.e. it directly adjoins the suction region. The feed into the suction region forms the connecting point mentioned.

Feeding the discharged setting fluid directly back into the suction region of the pump housing, or at least to a connecting point which is formed upstream of the pump port of the low-pressure side but downstream of the reservoir, counteracts the undesirable aeration which commonly occurs when it is fed back into the reservoir. The energy required to drive the pump is reduced, since the setting fluid which is fed back still has a higher pressure than the fluid situated in the reservoir. In particular in embodiments in which the setting fluid is fed directly back into the suction region of the pump housing, some pre-loading occurs on the low-pressure side of the pump. If, as is preferred, the fluid is a liquid such as for example a lubricating oil or a hydraulic oil, it is possible to counteract cavitation. If the setting fluid were discharged directly into the environment through the relief port, the setting fluid flowing back to the reservoir would be additionally contaminated. There would also be a risk of air, which reaches the working port via leaks and passes from there into the main flow which flows through the pump housing, being sucked into the control valve from the environment via the relief port. These two disadvantages are likewise eliminated by the invention. Another positive effect is that the control valve is sealed off from the reservoir. If the pump is used as a lubricating oil pump or a working oil pump, this typically causes a circulation of air and oil in the region of the reservoir, which can retroactively affect the control valve. This, too, is prevented by the invention. If the control valve is arranged in or on the pump housing, and the relief channel leads from the control valve up to and into the suction region through and/or on the pump housing, the pump together with the control valve can be more easily fitted as an fitted unit, and the risk of fitting errors reduced, since the relief port does not have to be specially connected to the delivery cycle.

The control valve can be embodied separately from the pump housing and, when the pump is arranged in a fluid delivery cycle, arranged away from or on the pump housing. Preferably, however, the control valve is an integral constituent part of the pump, in that the pump housing also forms a housing for the control valve. The pump housing can in particular form the valve space for the control piston. If the control valve is integrated or arranged on the pump housing, the pump housing can form the pressure port, the working port and the relief port of the control valve. The relief channel can extend on and/or in the pump housing, such that if the control valve is integrated or attached to the pump housing, it is not necessary to establish an additional connection for relieving pressure. The pump, including the control valve, can form a fitted unit, such that when the pump housing is fitted in the fluid delivery cycle, the control valve is automatically also at least mechanically fitted. With respect to fitting the pump housing and control valve in the delivery cycle, it is also advantageous if the connections for the three ports of the control valve mentioned are formed in and/or on the pump housing and there is no need for a connecting conduit and a port, separate from the pump housing, for the setting fluid. The setting fluid for the pressure port can then for example be diverted from the main flow in the pump housing on the latter's high-pressure side. If, however, the setting fluid is diverted at a point downstream of the pump housing on the high-pressure side, the diversion is preferably arranged downstream of a filter for cleaning the fluid, in order to feed cleaned setting fluid to the control valve.

Although the control force which acts on the control piston, or a force component of the control force, could be generated electromagnetically, embodiments in which the control force is exclusively generated fluidically, i.e. using a control fluid which acts on the control piston, are preferred. If the control valve is an integral constituent part of the pump housing or is arranged directly on the pump housing, it is advantageous if the control valve does not have to be supplied with electrical energy and/or signals in order to generate the control force, since electrical conduits are susceptible to faults in environments in which the pump is in many applications arranged, for example as a lubricating oil pump on a combustion engine. A connecting conduit for a control fluid is comparatively less problematic.

The control fluid can likewise be diverted from the high-pressure side of the pump. The control fluid can in particular be diverted at a point downstream of a filter for cleaning the fluid delivered by the pump, in order to feed cleaned fluid to a control chamber formed on the control piston. The control fluid can however in principle be diverted on the high-pressure side at a point which is still within the pump housing.

In preferred embodiments, the additional control device comprises a modulating valve which is arranged in a secondary flow conduit which diverts from the main flow on the high-pressure side of the pump, in order to be able to guide the diverted high-pressure fluid, as the control fluid, to the control chamber. The modulating valve is preferably an electromagnetic valve comprising a signal port for connecting to an external controller, for example an engine controller. The control fluid pressure which prevails in the control chamber can be modulated by means of the modulating valve. For the purpose of modulating the pressure, the modulating valve can be a manifold valve which exhibits discrete switching positions, or a proportional valve.

In preferred embodiments, the control valve comprises a first control chamber and a second control chamber, and the control piston comprises a first piston surface, to which a first control fluid pressure can be applied in the first control chamber, and a second piston surface to which a second control fluid pressure can be applied in the second control chamber. The control fluid for the respective control chamber can in each case be fluid diverted from the high-pressure side of the pump, wherein the control fluid for the first control chamber can be diverted at the same point as the control fluid for the second control chamber or at a different point to the control fluid for the second control chamber. The application of control fluid can in particular be embodied such that the first control chamber is connected to the main flow on the high-pressure side of the pump by means of a simple secondary flow conduit, while the modulating valve mentioned is arranged in the secondary flow conduit to the second control chamber. If the modulating valve can modulate the control fluid pressure in the second control chamber between a lower pressure, for example the ambient pressure or the pressure in the suction region of the pump housing, and a higher pressure, for example a pressure on the high-pressure side of the pump, the control force which acts on the control piston, counter to the tensing force, can be varied in a controlled way between two values, thus enabling the delivery characteristic curve of the pump to be correspondingly modulated using the setting fluid which acts on the adjusting device.

In preferred embodiments, the pump is a displacement pump. In displacement pumps, the delivery volume increases in proportion to the delivery speed of the delivery member if no steps are taken to adjust the delivery volume. If, as is preferred, the pump is a rotary pump, the delivery volume increases with the rotational speed of the delivery member which, in a rotary pump, can be rotated about a rotational axis within the delivery chamber. In principle, however, the invention also relates to linear stroke pumps. In generalised terms, the delivery volume is therefore proportional to the stroke frequency, rotational stroke frequency or linear stroke frequency of the pump. In the case of displacement pumps, reference is therefore also made to the specific delivery volume, i.e. the delivery volume per rotational or linear stroke. Proportionality is faulty in many applications, in particular when the speed at which the pump is driven cannot be adapted to the requirements of the assembly to be supplied. Pumps which are used in vehicles for example, such as lubricating oil pumps, servo pumps and coolant pumps, are mechanically driven by the drive motor of the vehicle. In these applications, the drive speed of the pump is dependent on the rotational speed of the drive motor and is in most cases in a fixed rotational speed relationship to the rotational speed of the drive motor. The invention is directed in particular to such applications.

In preferred embodiments, the adjusting device is configured to adjust the specific delivery volume of a displacement pump. Displacement pumps and adjusting devices such as the invention also in particular relates to are disclosed in the prior art discussed at the beginning. In addition to the vane cell pumps and externally toothed wheel pumps described therein, however, the invention also relates to internally toothed wheel pumps and reciprocating piston valve pumps which can be adjusted in terms of their delivery volume, and in principle also to other pump designs which can be adjusted in terms of their delivery volume. The invention also relates to fluid-flow machines, such as for example the radial fluid-flow machines which are commonly used in the case of coolant pumps. An example of a fluid-flow machine which can be adjusted in terms of its delivery volume and which comprises a radial feed wheel and an adjusting device comprising a split ring slider is described in US 2012/0204818 A1, which is incorporated by reference in this respect.

The adjusting device can in particular comprise an adjusting member which co-operates with the delivery member or, in pumps comprising multiple delivery members, at least one of the multiple delivery members, in order to adjust the delivery volume. If the pump is embodied as a vane cell pump comprising a delivery member which can be rotated within the delivery chamber, the adjusting member can in particular be an adjusting ring which surrounds the delivery member and is arranged such that it can be moved linearly or pivoted within the pump housing, such that an adjusting movement of the adjusting member adjusts the eccentricity between the rotary axis of the delivery member and a central longitudinal axis of the adjusting ring and thus adjusts the delivery volume. The delivery volume of internally toothed ring pumps and reciprocating piston valve pumps can also be adjusted in a similar way. In an internally toothed ring pump, the internally toothed hollow wheel can in particular form the adjusting member and be arranged such that it can be linearly moved or pivoted for the purpose of adjusting. If the pump is embodied as an externally toothed wheel pump, it comprises at least two delivery members which are toothed on the outer circumference, so-called externally toothed wheels. The externally toothed wheels are in toothed engagement with each other. For adjusting the specific delivery volume, one of the externally toothed wheels can be axially adjusted relative to the other, such that the engagement length of the externally toothed wheels and thus the delivery volume of the pump can be adjusted. The adjustable externally toothed wheel is a constituent part of an adjusting unit which can be axially shifted and which comprises pistons which can be axially shifted and between which the adjustable externally toothed wheel is mounted such that it can be rotated. In such pump embodiments, the pistons which are connected to each other form the adjusting member of the adjusting device. Adjusting devices which can be used in combination with radial feed wheels are described for example in the document US 2012/0204818 A1 mentioned previously. Following a discussion of various types of adjusting devices, this document describes in particular an adjusting device which comprises a split ring slider as the adjusting member, wherein the split ring slider surrounds the radial feed wheel.

The invention is not however restricted to the adjusting devices described above. The adjusting device can for example also comprise a transmission by means of which the pump is driven. In such embodiments, the delivery volume of the pump can be adjusted by adjusting the gearing-up or gearing-down ratio of the transmission.

Advantageous features of the invention are also described in the sub-claims and combinations of the sub-claims.

Features of the invention are also described in the aspects formulated below. The aspects are worded in the manner of claims and can be substituted for them. Features disclosed in the aspects can also supplement and/or qualify the claims, indicate alternatives to individual features and/or broaden claim features. Bracketed reference signs refer to example embodiments of the invention which are illustrated below in figures. They do not restrict the features described in the aspects to their literal sense as such, but do on the other hand indicate preferred ways of realising the respective feature.

Aspect 1. A pump which exhibits an adjustable delivery volume, the pump comprising:

(a) a pump housing (1, 2), comprising: a pump port (3) for connecting the pump (100) to a reservoir (98) of a fluid to be delivered; a delivery chamber (5) which comprises a delivery chamber inlet (6) on a low-pressure side of the pump, and a delivery chamber outlet (7) on a high-pressure side of the pump, for a fluid; and a suction region (4) extending from the pump port (3) up to at least the delivery chamber inlet (6) on the low-pressure side;

(b) a delivery member (10) which can be moved within the delivery chamber (5) for delivering the fluid from the low-pressure side to the high-pressure side, preferably a delivery rotor (10) which can be rotated about a rotational axis (Rio) within the delivery chamber (5);

(c) an adjusting device (20, 25, K) for adjusting the delivery volume of the pump;

(d) a control valve (30), comprising:

(d1) a pressure port (P) for a setting fluid which is diverted from the fluid of the high-pressure side;

(d2) a working port (A) for the setting fluid, which is connected to the adjusting device (20);

(d3) a relief port (S) for the setting fluid;

(d4) a valve space (31), and a control piston (32) which can be moved back and forth within the valve space (31) between a first piston position and a second piston position;

(d5) and a tensing device (33) for generating a tensing force which acts on the control piston (32) in the direction of one of the piston positions;

(e) and an additional control device (36, 37, 40) for generating a control force which acts on the control piston (32), counter to the tensing force of the tensing device (33), (f) wherein the control valve (30)

(f1) connects the working port (A) to the pressure port (P) when the control piston (32) is in the first piston position and (f2) separates the working port (A) from the pressure port (P) and connects the working port (A) to the relief port (S) when the control piston (32) is in the second piston position, (g) and wherein the relief port (S) is connected to the suction region (4) by bypassing the reservoir (98).

Aspect 2. The pump according to the preceding aspect, wherein the relief port (S) is connected to the suction region (4) by means of a relief channel (35; 39), and the relief channel (35; 39) feeds into the suction region (4) at or downstream of the pump port (3).

Aspect 3. The pump according to any one of the preceding aspects, wherein the relief port (S) is connected to the suction region (4), downstream of the pump port (3), by means of a relief channel (35; 39) which extends in and/or on the pump housing (1, 2).

Aspect 4. The pump according to the preceding aspect, wherein the control valve (30) is arranged in or on the pump housing (1, 2), and the relief channel (35; 39) extends from the relief port (S) up to and into the suction region (4) in and/or on the pump housing (1, 2).

Aspect 5. The pump according to any one of the preceding aspects, wherein: the pump housing (1, 2) comprises a housing structure (1), which surrounds the delivery chamber (5), and a housing cover (2) which is connected to the housing structure (1); the housing cover (2) together with the housing structure (1) forms a joining gap (la, 2*a*) extending around the delivery chamber (5); and the relief port (S) is connected to the suction region (4) by means of a relief channel (35; 39) which extends in and/or on the housing cover (2) and/or in the joining gap (1*a*, 2*a*).

Aspect 6. The pump according to the preceding aspect, wherein the relief port (S) is formed in the housing cover (2) or in the joining gap (1*a*, 2*a*).

Aspect 7. The pump according to any one of the preceding aspects, wherein:

the pump housing (1, 2) comprises a housing structure (1), which surrounds the delivery chamber (5), and a housing cover (2) which is connected to the housing structure (1);

the housing cover (2) together with the housing structure (1) forms a joining gap (1*a*, 2*a*) extending around the delivery chamber (5);

the valve space (31) of the control valve (30) extends in the movement direction of the control piston (32) up to and into or through the joining gap (la, 2*a*); and the housing cover (2) seals the valve space (31).

Aspect 8. The pump according to any one of the preceding aspects, wherein the valve space (31) comprises a tensing chamber (34) for the tensing device (33), and the relief port (S) feeds into the tensing chamber (34).

Aspect 9. The pump according to any one of the preceding aspects, wherein the tensing force acts on the control piston (32) in the direction of the second piston position.

Aspect 10. The pump according to any one of the preceding aspects, wherein the control valve (30) is arranged outside the suction region (4).

Aspect 11. The pump according to any one of the preceding aspects, wherein the pump (100) is arranged in a delivery cycle which comprises the reservoir (98), which is connected to the pump port (3), on the low-pressure side and at least one assembly (M), which is to be supplied with the fluid by the pump (100), on the high-pressure side.

Aspect 12. The pump according to the preceding aspect, wherein a filter for cleaning the fluid guided in a main flow (101) is arranged on the high-pressure side of the pump (100) in the main flow (101) which is guided to the at least one assembly (M) by the pump (100), and the setting fluid is diverted at a point downstream of the filter on the high-pressure side of the pump (100) and is guided to the pressure port (P) of the control valve (30).

Aspect 13. The pump according to any one of Aspects 1 to 11, wherein the setting fluid is diverted on the high-pressure side in the pump housing (1, 2) and is guided to the pressure port (P) of the control valve (30) in and/or on the pump housing (1, 2).

Aspect 14. The pump according to any one of the preceding aspects, wherein the additional control device (36, 37, 40) is configured to modulate the magnitude of the tensing force, preferably in accordance with the requirements of an assembly to be supplied with the fluid by the pump (100).

Aspect 15. The pump according to any one of the preceding aspects, wherein the additional control device (36, 37, 40) is connected to an external controller, preferably a controller of an assembly to be supplied with the fluid by the pump (100), and is configured to modulate the magnitude of the tensing force in accordance with control signals of the external controller.

Aspect 16. The pump according to the preceding aspect, wherein the external controller is an engine controller, preferably a characteristic-curve controller or characteristic-map controller, of a drive motor for a motor vehicle.

Aspect 17. The pump according to any one of the preceding aspects, wherein the control valve (30) comprises a control chamber (37) comprising an inlet (Y) for a control fluid for generating the control force by way of a control fluid pressure which acts on the control piston (32) within the control chamber (37).

Aspect 18. The pump according to the preceding aspect, wherein the additional control device (36, 37, 40) comprises a modulating valve (40), which is arranged in a flow path of the control fluid, for changing the control fluid pressure acting in the control chamber (37), wherein the control fluid is preferably diverted on the high-pressure side of the pump from the fluid delivered by the pump (100).

Aspect 19. The pump according to any one of the preceding aspects, wherein:

the control piston (32) comprises a first piston surface (36*a*) and a second piston surface;

the control valve (30) comprises a first control chamber (36) for generating a first control fluid pressure which acts on the first piston surface (36*a*), counter to the tensing force, and a second control chamber (37) for generating a second control fluid pressure which acts on the second piston surface (37*a*), counter to the tensing force;

and the additional control device (36, 37, 40) comprises a modulating valve (40) for changing the first control fluid pressure and/or the second control fluid pressure.

Aspect 20. The pump according to any one of the preceding aspects, wherein:

the control piston (32) comprises a first piston surface (36*a*) and a second piston surface (37*a*);

the control valve (30) comprises a first control chamber (36) comprising a first control port (X) for a control fluid for generating a first control force by way of a first control fluid pressure which acts on the first piston surface (36*a*), counter to the tensing force, within the first control chamber (36) and a second control chamber (37) comprising a second control port (Y) for a control fluid for generating a second control force by way of a second control fluid pressure which acts on the second piston surface (37*a*), counter to the tensing force, within the second control chamber (37);

and the additional control device (36, 37, 40) comprises a modulating valve (40) for changing the first control fluid pressure and/or the second control fluid pressure.

Aspect 21. The pump according to the preceding aspect, wherein the first control fluid and/or the second control fluid is diverted on the high-pressure side of the pump from the fluid delivered by the pump (100).

Aspect 22. The pump according to any one of the immediately preceding two aspects, wherein: the first control fluid and preferably also the second control fluid is diverted on the high-pressure side of the pump from the fluid delivered by the pump (100); the first control fluid is fed, unmodulated, to the first control chamber (36); and the modulating valve (40) is arranged in a flow path of the second control fluid, in order to be able to modulate the second control fluid pressure.

Aspect 23. The pump according to any one of Aspects 18 to 22, wherein the modulating valve (40) is a manifold electromagnetic valve.

Aspect 24. The pump according to any one of Aspects 18 to 23, wherein the modulating valve (40) is embodied separately from the pump housing (1, 2) and is arranged separately from the pump housing (1, 2) in a delivery cycle of the pump (100).

Aspect 25. The pump according to any one of Aspects 17 to 24, wherein the control fluid is diverted on the high-pressure side at a point downstream of a filter for cleaning the fluid.

Aspect 26. The pump according to any one of the preceding aspects, wherein: the adjusting device (20, 25, K) comprises an adjusting member (20), which is assigned to the delivery member (10), and a setting pressure chamber (K); the setting pressure chamber (K) is connected to the working port (A) of the control valve (30); the setting fluid can be applied to the adjusting member (20) in the setting pressure chamber (K) in a setting direction in which it can move; and the adjusting device (20, 25, K) also comprises a spring device (25) which exerts a spring force, counter to the pressure of the setting fluid, on the adjusting member (20).

Aspect 27. The pump according to any one of the preceding aspects, wherein:

the pump (100) is a rotary pump, and the delivery member (10) is a delivery rotor (10) which can be rotated about a rotary axis (Rio) within the delivery chamber (5);

the adjusting device (20, 25, K) comprises an adjusting member (20) which surrounds the delivery rotor (10) or is arranged on an end-facing side of the delivery rotor (10) and can be moved back and forth within the pump housing (1, 2) for the purpose of adjusting the delivery volume and a setting pressure chamber (K) which is connected to the working port (A) of the control valve (30);

and the setting fluid can be applied to the adjusting member (20) in the setting pressure chamber (K) in a setting direction in which it can move.

Aspect 28. The pump according to the preceding aspect, wherein the pump (100) is a displacement pump, preferably a vane pump, an internally toothed wheel pump, a reciprocating piston valve pump or an externally toothed wheel pump.

Aspect 29. The pump according to any one of the immediately preceding two aspects, wherein the adjusting member (20) surrounds the delivery rotor (10) and can be pivoted or translationally moved transverse or parallel to the rotary axis (Rio) of the delivery rotor (10) relative to the delivery rotor (10), wherein the adjusting member (20) together with the delivery rotor (10) preferably forms delivery cells in which the fluid can be delivered from the delivery chamber inlet (6) to the delivery chamber outlet (7) by rotating the delivery rotor (10).

Aspect 30. The pump according to any one of Aspects 1 to 27 or 29, wherein the pump is a fluid-flow machine, the delivery member is a radial feed wheel, and the adjusting member is a split ring slider which surrounds the radial feed wheel and can be axially moved, and wherein the setting pressure chamber is arranged on an end-facing side of the split ring slider.

Aspect 31. The pump according to Aspect 26 or 27, preferably an externally toothed wheel pump, wherein: the pump comprises another delivery rotor which is in delivery engagement with the delivery rotor and is arranged with an external axle with respect to the delivery rotor; the adjusting member is a setting piston which is arranged on the end-facing side of the delivery rotor (10); the adjusting device comprises another setting piston which is arranged on the other end-facing side of the delivery rotor; the delivery rotor is mounted such that it can be rotated relative to the other delivery rotor between the setting pistons; the setting pistons together with the delivery rotor can be moved axially and translationally relative to the other delivery rotor, such that an axial engagement length of the delivery engagement can be adjusted; and the setting pressure chamber is formed on an end-facing side of the adjusting member which faces away from the delivery rotor.

Aspect 32. The pump according to any one of the preceding aspects, wherein the pump is driven in accordance with the speed of an assembly to be supplied with the fluid by the pump and is preferably driven by the assembly in a fixed rotational speed relationship to the assembly.

Aspect 33. The pump according to any one of the preceding aspects, wherein the fluid is a lubricating oil, and the pump is a lubricating oil pump in a lubricating oil delivery cycle of a combustion engine, preferably a drive motor of a motor vehicle, and is used to supply the combustion engine with the lubricating oil.

Aspect 34. The pump according to any one of the preceding aspects, wherein the fluid is used as a working fluid, and the pump supplies a transmission, such as for example an automatic transmission, preferably a transmission of a vehicle, with the working fluid.

Aspect 35. The pump according to any one of Aspects 1 to 32, wherein the fluid is used as a coolant, and the pump is a coolant pump in the coolant cycle of a combustion engine, preferably a drive motor of a motor vehicle, and supplies the combustion engine with the coolant.

BRIEF DESCRIPTION OF THE DRAWINGS

Example embodiments of the invention are described below on the basis of figures. Features disclosed by the example embodiments, each individually and in any combination of features, advantageously develop the subject-matter of the claims and the embodiments described above and also the subject-matter of the aspects. There is shown:

DETAILED DESCRIPTION OF THE INVENTION

Figure 1:
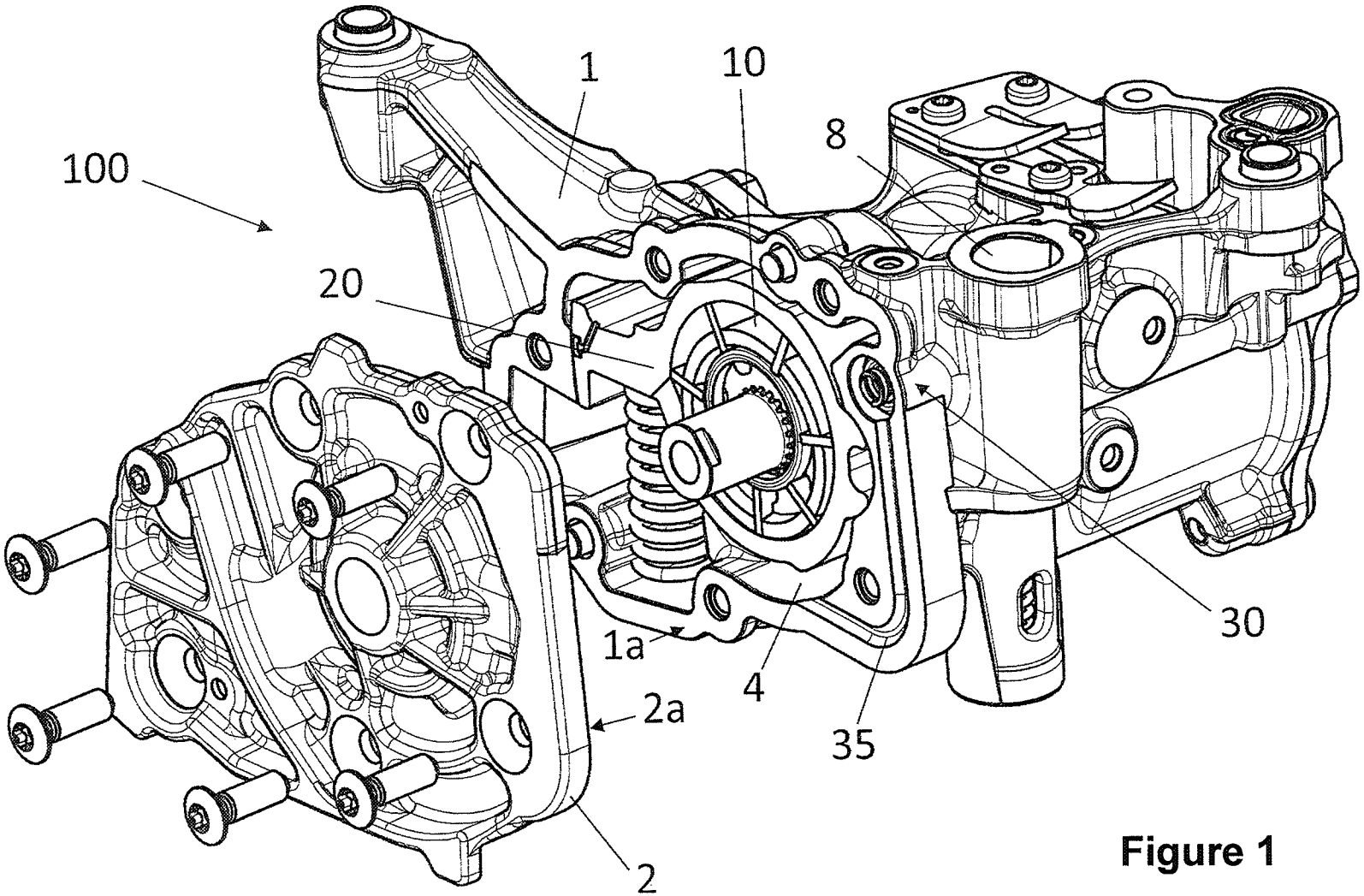
FIG. 1 a pump which can be adjusted in terms of its delivery volume and which comprises a control valve and a relief channel of a first example embodiment, in an isometric representation.

FIG. 1 shows a pump in a vane cell design by way of example. The pump comprises a pump housing comprising a housing structure 1 and a cover 2. The housing structure 1 accommodates and/or mounts components of the pump such that they can be moved. The housing structure 1 is open on an axial end-facing side, thus facilitating the arrangement of components of the pump in or on the housing structure 1. The cover 2 can be fitted to the housing structure 1 and, when fitted, seals the housing structure 1 on the end-facing side in question. The housing structure 1 and the cover 2 comprise joining surfaces 1*a* and 2*a* which axially face each other and which are axially pressed against each other when the cover 2 is attached to the housing structure 1, such that an internal space of the pump housing 1, 2 is circumferentially sealed off.

Figure 2:
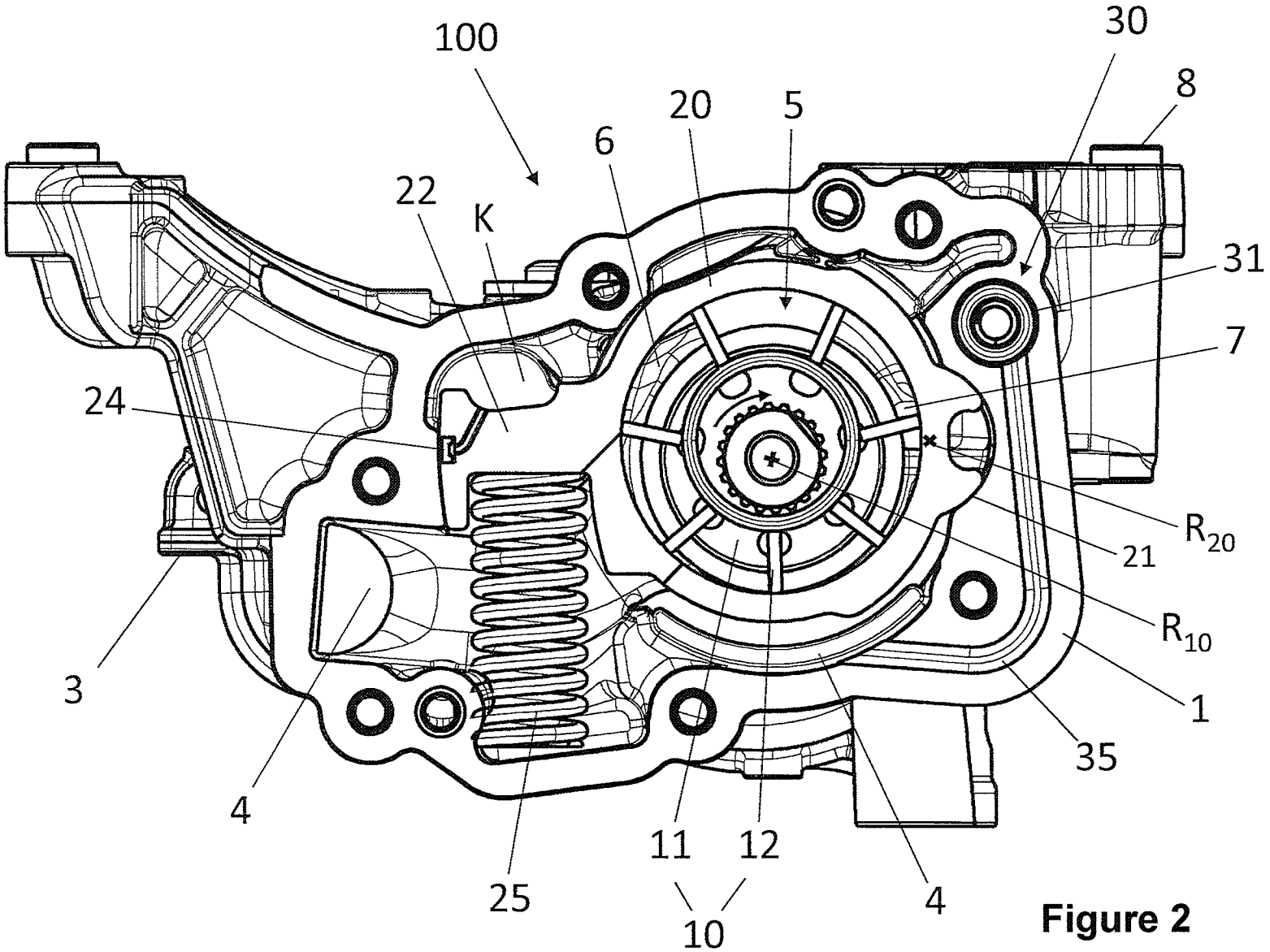
FIG. 2 the pump in a plan view.

FIG. 2 shows the pump in a plan view onto the open housing structure 1. The cover 2 has been removed, such that functional components of the pump can be seen.

The housing structure 1 surrounds a delivery chamber 5 in which a delivery member 10 is arranged such that it can be rotated about a rotational axis Rio. The housing structure 1 comprises a pump port 3 which is used as an inlet, and a pump port 8 which is used as an outlet, for a fluid to be delivered, for example engine lubricating oil. The pump port 3 on the low-pressure side is used to connect the pump to a reservoir for the fluid, and the pump port 8 on the high-pressure side is used to connect to an assembly to be supplied with the fluid. The delivery chamber 5 comprises a low-pressure side and a high-pressure side. When the delivery member 10 is rotary-driven in the rotational direction indicated, i.e. clockwise, fluid flows through the pump port 3 into the pump housing 1, 2 and through a delivery chamber inlet 6 on the low-pressure side in the pump housing 1, 2, into the delivery chamber 5, and is expelled at an increased pressure through the delivery chamber outlet 7 on the high-pressure side of the pump and discharged via the pump port 8. A suction region 4 is formed on the low-pressure side of the pump housing 1, 2, wherein the fluid delivered by the pump flows through the suction region 4 on its flow path from the pump port 3 to the delivery chamber inlet 6. Due to the design of the pump 100, the suction region 4 extends up to and into the delivery chamber 5 and also comprises the region of the delivery chamber 5 in which the delivery cells increase in size when the delivery member 10 is rotated. A high-pressure region of the pump housing 1, 2 which adjoins the suction region 4 on the flow path comprises the region of the delivery chamber 5 in which the delivery cells decrease in size and extends from this partial region of the delivery chamber 5 up to and including the pump port 8 via the delivery chamber outlet 7.

The delivery member 10 is a delivery rotor—in the example, an impeller—comprising a rotor structure 11, which is central with respect to the rotational axis Rio, and vanes 12 which are arranged in a distribution over the circumference of the rotor structure 11. The vanes 12 are guided, such that they can be shifted in a sliding manner in the radial direction or at least substantially in the radial direction, in slots in the rotor structure 11 which are open towards the outer circumference of the rotor structure 11.

The outer circumference of the delivery member 10 is surrounded by an adjusting member 20 which is, by way of example, shaped as an adjusting ring. When the delivery member 10 is rotary-driven, its vanes 12 slide over an inner circumferential surface of the adjusting member 20. The rotational axis $R_{10}$ of the delivery member 10 is arranged eccentrically with respect to a parallel axis of the adjusting member 20 which is central in relation to the inner circumferential surface, such that delivery cells formed by the delivery member 10 and the adjusting member 20 increase in size on the low-pressure side of the delivery chamber 5 and decrease in size again on the high-pressure side in the rotational direction when the delivery member 10 is rotated. Because the delivery cells increase and decrease in size periodically with the rotational speed of the delivery member 10 in this way, the fluid is delivered from the low-pressure side to the high-pressure side, where it is delivered at an increased pressure through the delivery chamber outlet 7 and then through the pump port 8.

The volume of fluid delivered by each revolution of the delivery member 10, the so-called specific delivery volume, can be adjusted. If the fluid is a liquid and thus a good approximation of an incompressible fluid, the absolute delivery volume is directly proportional to the rotational speed of the delivery member 10. In the case of compressible fluids, for example air, the relationship between the delivered amount and the rotational speed may not be linear, but the absolute delivered amount and/or mass likewise increases with the rotational speed.

The specific delivery volume depends on the eccentricity, i.e. the distance between the central axis of the adjusting member 20 and the rotational axis $R_{10}$ of the delivery member 10. In order to be able to change this axial distance, the adjusting member 20 is arranged such that it can be moved within the pump housing 1, 2—by way of example, pivoted about a pivot axis $R_{20}$. In variations, a modified adjusting member can also be arranged such that it can be linearly moved within the pump housing 1, 2. For adjusting the specific delivery volume and/or eccentricity, it is preferably able to move transverse to the rotational axis $R_{10}$ of the delivery member 10. It would in principle also be conceivable for it to be axially adjustable, thus enabling an axial width of the delivery cells to be adjusted.

A pivot bearing region of the adjusting member 20 is denoted by 21. The pivot bearing is embodied as a slide bearing, in that the pivot bearing region 21 of the adjusting member 20 is in direct sliding contact with a co-operating surface of the housing 1.

For the purpose of adjusting in a setting direction—in the example embodiment, the pivoting direction—a setting fluid pressure which acts in a setting direction is applied to the adjusting member 20. A restoring force acts in the opposite setting direction, counter to this setting pressure. The restoring force is generated by a spring device comprising one or more mechanical spring members—in the example embodiment, a single spring member 25. The spring member 25 is embodied and arranged as a helical pressure spring. For the purpose of applying pressure using the setting fluid, the side of the adjusting member 20 which lies opposite as viewed from the pivot axis $R_{20}$ across the rotational axis $R_{10}$ of the delivery member 10 comprises an acting region 22 of the adjusting member 20 which functionally acts as an adjusting piston and which is formed integrally with an annular portion of the adjusting member 20. On one side of the acting region 22 of the adjusting member 20, a setting pressure chamber K is formed in the pump housing 1, 2, into which the setting fluid can be introduced in order to exert a setting force, which acts in the setting direction, on the acting region 22 of the adjusting member 20 and via the latter on the adjusting member 20. The restoring force likewise, by way of example, acts directly on the acting region 22 of the adjusting member 20.

The setting pressure chamber K is fed with the setting fluid delivered by the pump, in order to apply the setting fluid pressure to the adjusting member 20 in the setting direction, against the force of the spring member 25. The setting direction is selected such that the eccentricity between the delivery member 10 and the adjusting member 20 and thus the specific delivery volume of the pump decreases in size when the adjusting member 20 is moved in the setting direction.

The adjusting member 20 together with the housing 1 forms a sealing gap which separates the setting pressure chamber K from the low-pressure region in the setting direction. A sealing element 24 is arranged in the sealing gap in order to better seal off the sealing gap. The sealing element 24 is arranged in a receptacle of the adjusting member 20.

In relation to controlling or regulating the delivery volume by applying the control fluid pressure as described, reference is made to DE 10 2011 086 175 B3, which is incorporated by reference in this respect and also with respect to other details of the functionality of the pump of the example embodiment.

The pump comprises a control valve 30 for influencing the setting pressure which prevails in the setting pressure chamber K. The control valve 30 is an integral constituent part of the pump 100, in that the pump housing 1, 2 also forms the housing of the control valve 30. The pump, including the control valve 30, can be fitted as a unit. The delivery and adjusting components, such as in particular the delivery member 10 and the adjusting member 20, and the control valve 30 are combined by means of the common pump housing 1, 2 to form a fitted unit.

A relief channel 35 connects the control valve 30 directly to the suction region 4. The relief channel 35 extends in the pump housing 1, 2 directly from the control valve 30 all the way to the suction region 4. It feeds into a valve space 31 of the control valve 30, formed by the pump housing 1, 2, at one end and into the suction region 4 at the other end. In the example embodiment shown, the relief channel 35 is formed in the joining surface 1*a* of the housing structure 1, and the cover 2—when fitted—seals off the relief channel 35 in a fluid seal.

Figure 3:
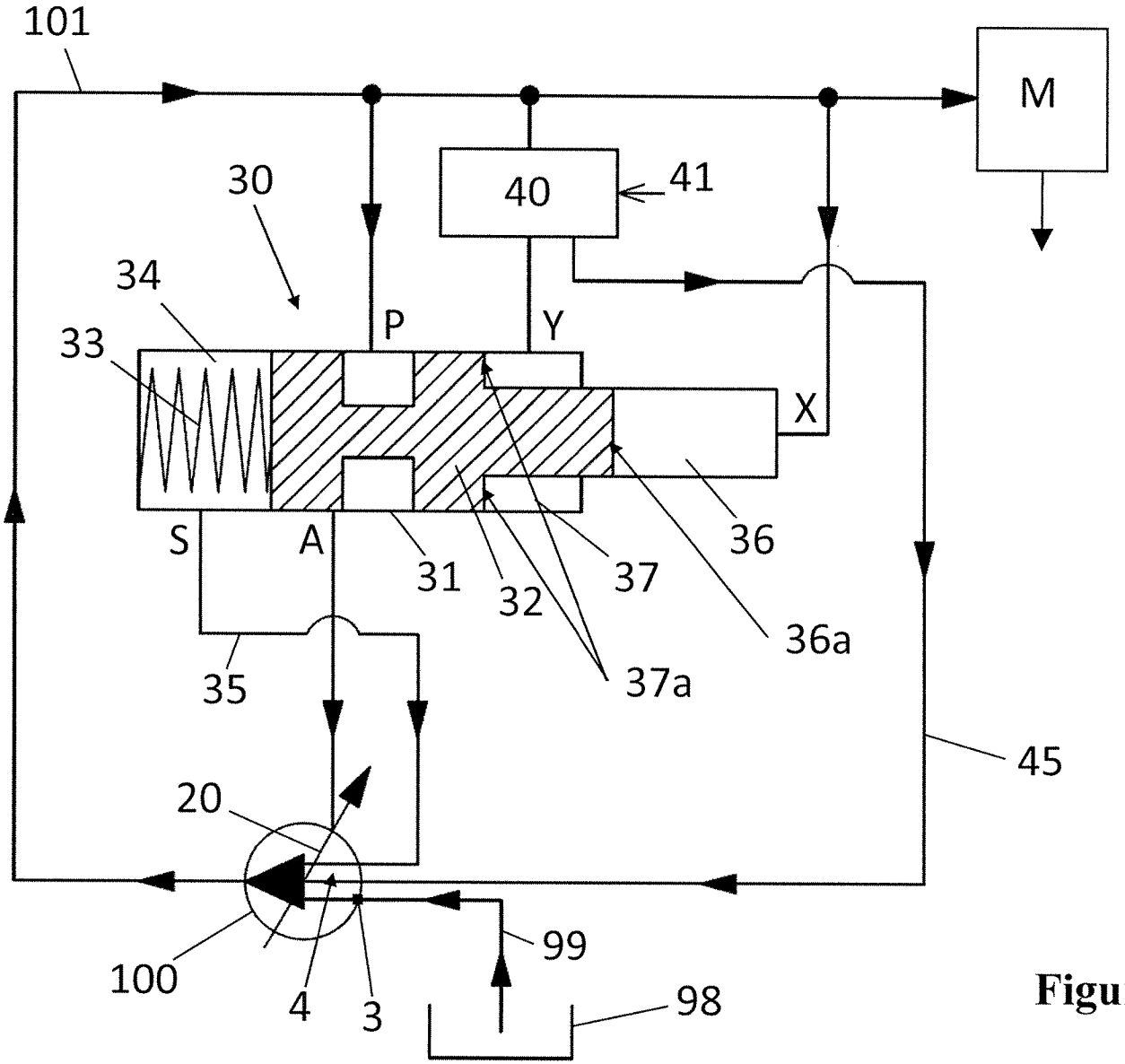
FIG. 3 a delivery cycle which comprises the pump, in a schematic representation.

FIG. 3 schematically shows a fluid delivery cycle containing the pump 100. The pump 100 delivers fluid from a reservoir 98 to an assembly M to be supplied with the fluid, for example lubricating oil to an internal combustion engine, for driving a motor vehicle, which forms the assembly M. Once it has flowed through the assembly M, the fluid—relieved of pressure—flows back into the reservoir 98. On the low-pressure side, the pump 100 delivers the fluid from the reservoir 98, through a feed conduit 99, the pump port 3 and the suction region 4 of the pump housing 1, 2, into the delivery chamber 5 (FIG. 2), from which it is expelled at an increased pressure. On the high-pressure side, a main flow 101 is delivered to the assembly M by the pump 100. A smaller portion is diverted from the main flow 101 and guided, as a setting fluid, to a pressure port P of the control valve 30. The pressure port P is correspondingly connected to the main flow 101 via a secondary flow conduit. The control valve 30 is connected to the adjusting device of the pump 100 via a working port A. The adjusting device comprises the setting pressure chamber K (FIG. 2) and the schematically indicated adjusting member 20. The adjusting device can comprise another setting pressure chamber or, as applicable, multiple other setting pressure chambers in which the setting fluid or a different setting fluid acts on the adjusting member 20. In FIG. 3, the adjusting member 20 also stands for the other components of the adjusting device, such as for example the setting pressure chamber K, the spring member 25 and optionally one or more other setting pressure chambers.

The control valve 30 also comprises a relief port S for the setting fluid. The relief port S is directly connected to the suction region 4 via the relief channel 35. The reservoir 98 is bypassed. No fluid flows to the reservoir 98 through the relief port S, and no fluid flows from the reservoir 98 to the control valve 30 through the relief port S. There is therefore no fluid communication between the relief port S and the reservoir 98. The pressurised setting fluid is fed back into the suction region 4 energy-efficiently via the relief port S. Setting fluid which is fed back for relieving pressure on the adjusting member 20 does not first have to be suctioned again from the reservoir 98 by the pump 100. The setting fluid, which is fed back via a short path, exhibits a higher pressure than the fluid situated in the reservoir and contains less air. Both these factors help to improve the effectiveness of the pump 100.

The control valve 30 comprises a valve space 31, which—as already mentioned—is formed by the pump housing 1, 2, and a control piston 32 which can be moved within the valve space 31. The control piston 32 can be moved back and forth within the valve space 31 between a first piston position and a second piston position. In FIG. 3, the control piston 32 assumes an intermediate position between the first piston position and second piston position. In the intermediate position shown, the control piston 32 separates the pressure port P from both the working port A and the relief port S. If the working port A is connected to the setting pressure chamber K (FIG. 2), then the control valve 30 blocks the setting pressure chamber K when the control piston 32 is in the intermediate position, such that aside from unavoidable leakage losses, the setting pressure which prevails in the setting pressure chamber K remains constant.

If the control piston 32 is moved from the intermediate position into the first piston position, i.e. to the left in FIG. 3, the pressure port P is connected to the working port A, such that the setting fluid reaches the adjusting device, and the setting pressure—i.e. a pressure of the high-pressure side of the pump 100—is applied to the adjusting member 20, wherein the adjusting device is designed such that an increase in the setting pressure reduces the specific delivery volume of the pump 100.

If the control piston 32 is moved from the intermediate position into the second piston position, i.e. to the right in FIG. 3, the working port A is initially separated from the pressure port P and subsequently, when the second piston position has been reached, connected to the relief port S and the relief channel 35. When the control piston 32 is in the second piston position, the setting fluid can flow off into the valve space 31 via the working port A and from the valve space 31 into the suction region 4 via the relief port S. When the control valve 30 is in this state, with the control piston 32 in the second piston position, the setting pressure chamber K (FIG. 2) and/or optionally a different setting pressure chamber of the adjusting device is pressurised to the comparatively lower pressure of the suction region 4, thus achieving an effective relief of pressure on the adjusting member 20.

The control valve 30 comprises a tensing device 33 which exerts a tensing force, which acts in the direction of the second piston position, on the control piston 32. The tensing device 33 is, by way of example, a helical pressure spring which is arranged in a tensing chamber 34 of the valve space 31 and acts on an axial end-facing side of the control piston 32. The relief port S feeds into the tensing chamber 34.

A first control pressure chamber 36 comprising a first chamber port X and a second control pressure chamber 37 comprising a second chamber port Y are formed in the valve space 31. A control pressure of a control fluid can be applied to the control piston 32 in each of the control pressure chambers 36 and 37. The respective control fluid acts on a first piston surface (36*a*) of the control piston 32, which in the example embodiment is embodied as a stepped piston, in the control pressure chamber 36 and on a second piston surface (37*a*) of the control piston 32 in the control pressure chamber 37. The respective control fluid exerts a first control force on the control piston 32 in the control pressure chamber 36 and a second control force on the control piston 32 in the control pressure chamber 37 in accordance with the control pressures and piston surfaces. The control valve 30 is embodied such that the first control force and second control force each act counter to the tensing force of the tensing device 33.

At its chamber port X, the control pressure chamber 36 is permanently connected to the main flow 101, delivered by the pump 100, via a secondary flow conduit which diverts from the main flow 101. The fluid delivered by the pump is thus also used as a control fluid, wherein a control pressure which permanently prevails in the control pressure chamber 36 during pump operations depends on the pressure of the high-pressure side of the pump 100 and for example at least substantially corresponds to the pressure at the diversion point.

In order to be able to apply control fluid to the second control pressure chamber 37, the control fluid for this chamber 37 is also diverted from the main flow 101. The control fluid diverted from the main flow 101 to the control pressure chamber 37 is guided to the chamber port Y via another secondary flow conduit, but not directly. A modulating valve 40 is arranged in this secondary flow conduit. The chamber port Y can be optionally connected to the main flow 101, or instead to the suction region 4 via a feedback conduit 45, by means of the modulating valve 40. The control valve 30 and the modulating valve 40 are thus configured for permanently applying a first control pressure to the control piston 32, counter to the tensing force of the tensing device 33, in the first control pressure chamber 36 and enabling a second control pressure, which likewise acts counter to the tensing force, and thus an additional control force to be optionally connected up or cut off, up or down to the pressure of the suction region 4.

The modulating valve 40 can be configured to switch back and forth only between the two switched states mentioned. It can also be configured to assume one or more middle switched states between the two extreme switched states, in order to be able to vary the additional control force in multiple increments. The modulating valve 40 can also be configured to continuously vary the control pressure in the second control pressure chamber 37 and thus the additional control force.

The control pressures prevailing in the control pressure chambers 36 and 37 which achieve an equilibrium between the forces acting on the control piston 32—on the one hand, the tensing force of the tensing device 33 and on the other hand, the control forces generated by the control fluid—can be specifically modulated by means of the modulating valve 40. The equilibrium pressure of the fluid delivered by the pump 100 which is achieved when the forces are in equilibrium can be modulated correspondingly and the delivery characteristic curve of the pump 100—the delivery pressure over the rotational speed of the pump—thus varied. An upper limit for the delivery pressure can in particular be adjusted, for example optionally set to one of at least two different pressure levels.

For relieving pressure on the second control pressure chamber 37, the control fluid is channelled back to the pump 100 in a feedback conduit 45 by bypassing the reservoir 98, preferably directly into the suction region 4 of the pump housing 1, 2 as in the example embodiment. In a modification, the feedback conduit 45 can instead also be guided back to the low-pressure side of the pump 100, likewise by bypassing the reservoir 98, to a connecting point downstream of the reservoir 98 and upstream of the pump port 3. The statements made with respect to the setting fluid correspondingly apply to feeding the control fluid back by bypassing the reservoir 98. Although the control fluid for relieving pressure is fed back in the preferred embodiments by bypassing the reservoir 98, conventional arrangements in which the control fluid for relieving pressure is fed back to the reservoir 98 are not to be excluded.

The modulating valve 40 is an electromagnetic valve. It can be a proportional valve using which the control pressure in the control pressure chamber 37 can be continuously adjusted. It can in particular however also be a manifold switching valve which can be switched between two, three or as applicable even more switched states. In the example embodiment, the modulating valve 40 is such a switching valve and connects the control pressure chamber 37 to the high-pressure side of the pump—in the example embodiment, the main flow 101—in a first switched state and separates it from the high-pressure side of the pump and instead connects it to the pump 100 via the feedback conduit 45, by bypassing the reservoir 98, in a second switched state. The control pressure chamber 37 is therefore connected to the high-pressure side of the pump 100 when the modulating valve 40 is in the first switched state, and to the low-pressure side of the pump 100 when the modulating valve 40 is in the second switched state. If the modulating valve 40 assumes the first switched state, the control pressures in the control pressure chambers 36 and 37 jointly act on the control piston 32 in the direction of the first piston position, counter to the tensing force of the tensing device 33. If the modulating valve 40 assumes the second switched state, the control pressure only then effectively acts on the control piston 32 in the first control pressure chamber 36. This control pressure has to be corresponding higher in order to move the control piston 32 into the first piston position, against the restoring tensing force of the tensing device 33. When the first piston position has been assumed, the pressure port P is connected to the working port A, such that the setting pressure of the setting fluid—in this case, the pressure of the high-pressure side of the pump 100—acts on the adjusting member 20 and thus in the direction of reducing the delivery volume of the pump.

The modulating valve 40 comprises a signal port 41 at which it is connected to an external controller. If the assembly M is a drive motor of a vehicle, an engine controller can in particular form the external controller. Such engine controllers are typically formed as characteristic-curve controllers or characteristic-map controllers. In an engine characteristic-map controller, the requirements of the drive motor can be stored in an electronic memory of the controller in a characteristic map of different engine variables, for example a temperature and/or rotational speed of the engine and/or a lubricating oil pressure at a critical point in the engine and/or the load state of the engine and so forth. On the basis of corresponding measured variables and the stored characteristic map, the external controller forms the output signal using which it actuates the modulating valve 40 in order to modulate the delivery pressure of the pump 100 which is sufficient to move the control piston 32 into the first piston position.

Figure 4:
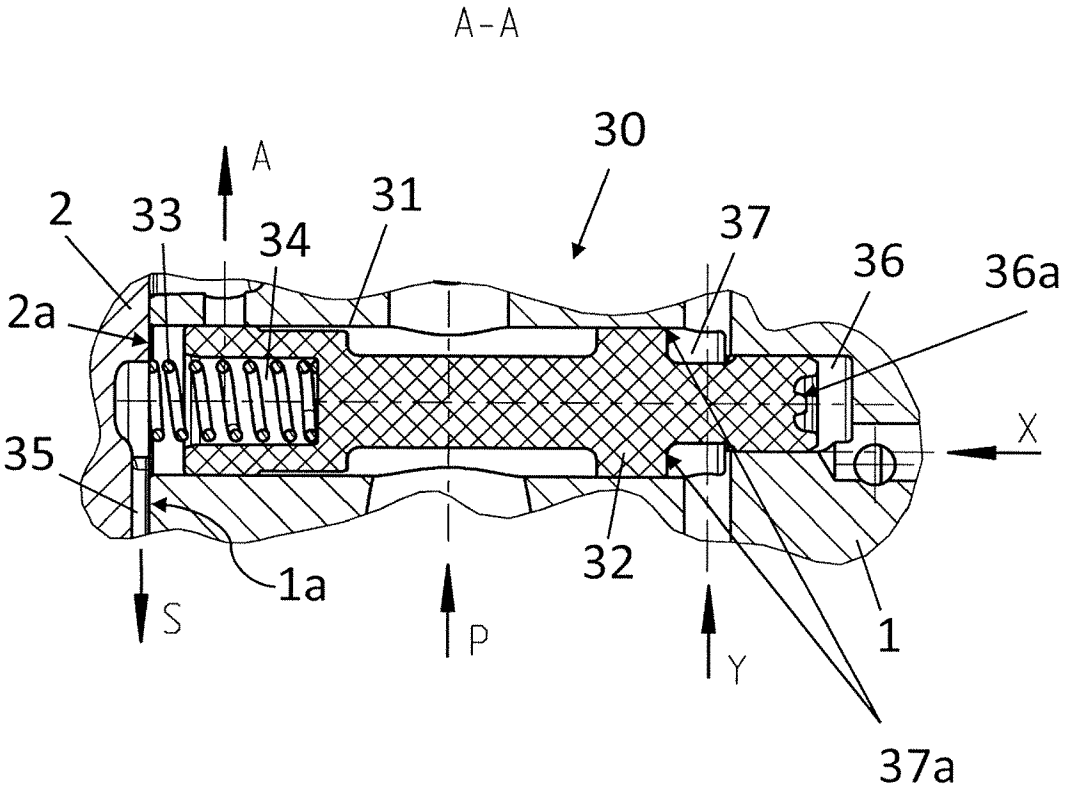
FIG. 4 the control valve in a longitudinal section.

FIG. 4 shows the control valve 30 in a longitudinal section. The ports A, P and S for the setting fluid and the ports X and Y for the control fluid, together with the end portions of the feed and drainage channels extending within the pump housing 1, 2, can be seen. The shape of the control piston 32, in order to obtain a stepped piston comprising a first piston surface (36*a*) to which the control fluid is applied in the control pressure chamber 36 and a second piston surface (37*a*) to which fluid is applied in the control pressure chamber 37, can likewise be seen.

The valve space 31 is formed primarily in the housing structure 1, as an axial blind bore by way of example. It is open in the direction of the cover 2 at one of the two end faces of the control piston 32. The cover 2 seals the valve space 31 at the open end. The tensing chamber 34 is formed in the end region of the valve space 31 which is sealed by the cover 2, such that the control piston 32 and then the tensing device 33 can be inserted through the opening, into the valve space 31. Once the cover 2 has been fitted, the tensing device 33 is axially supported on it.

The relief channel 35 feeds into the tensing chamber 34, such that the tensing chamber 34 is connected to the suction region 4 of the pump housing 1, 2 in any state of the control valve 30, i.e. irrespective of the position of the control piston 32.

Figure 5:
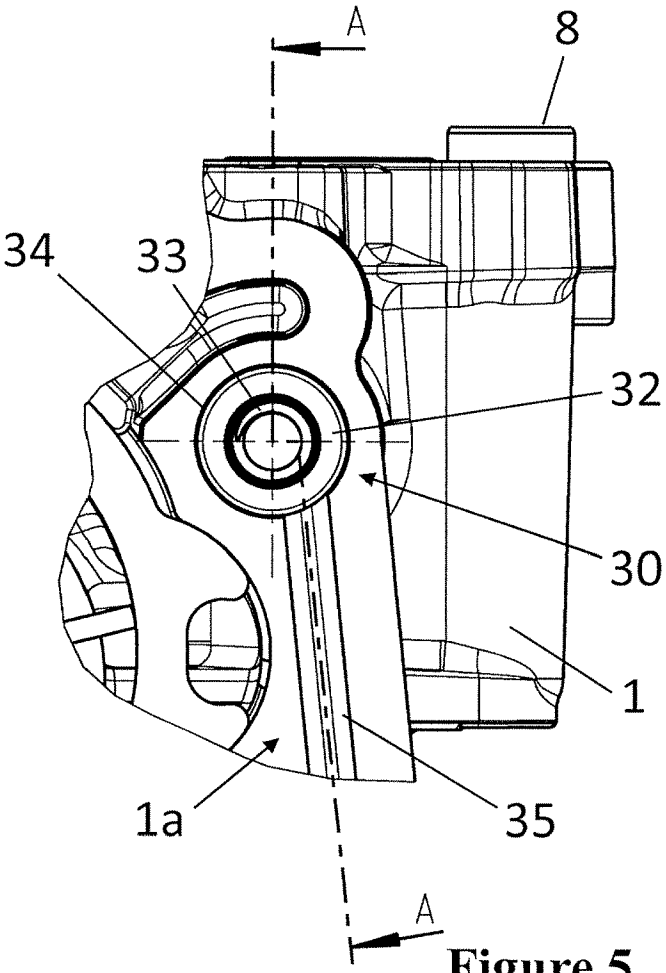
FIG. 5 a region of the pump which comprises the control valve, in a plan view.

FIG. 5 shows the immediate vicinity of the control valve 30 in a plan view onto the joining surface 1*a* of the housing structure 1. The cover 2 has been removed, such that there is a clear view into the valve space 31. The control piston 32 has been inserted, and the tensing device 33 has likewise been positioned. It is then merely necessary to attach the cover 2 to the housing structure 1 in order to complete the pump as such, including the integrated control valve 30 for arranging in a delivery cycle.

In the first example embodiment, the relief channel 35 is formed completely on the housing structure 1. The relief channel 35 extends in the joining surface 1*a* as a channel which is open in the direction of the cover 2 and sealed off by the cover 2 when the latter is fitted. In a modification, the relief channel 35 can instead also be formed in the joining surface 2*a* of the cover 2, where it exhibits the same profile as the relief channel 35 formed on the housing structure 1 in the first example embodiment. Such a modification is indicated in FIG. 4. Only an end portion of the relief channel 35 near the control valve 30 can be seen in FIG. 4. The end portion extends in the joining surface 2*a* of the cover 2 and not, as illustrated in FIGS. 2 and 5 for the first example embodiment, in the joining surface 1*a* of the housing structure 1.

Figure 6:
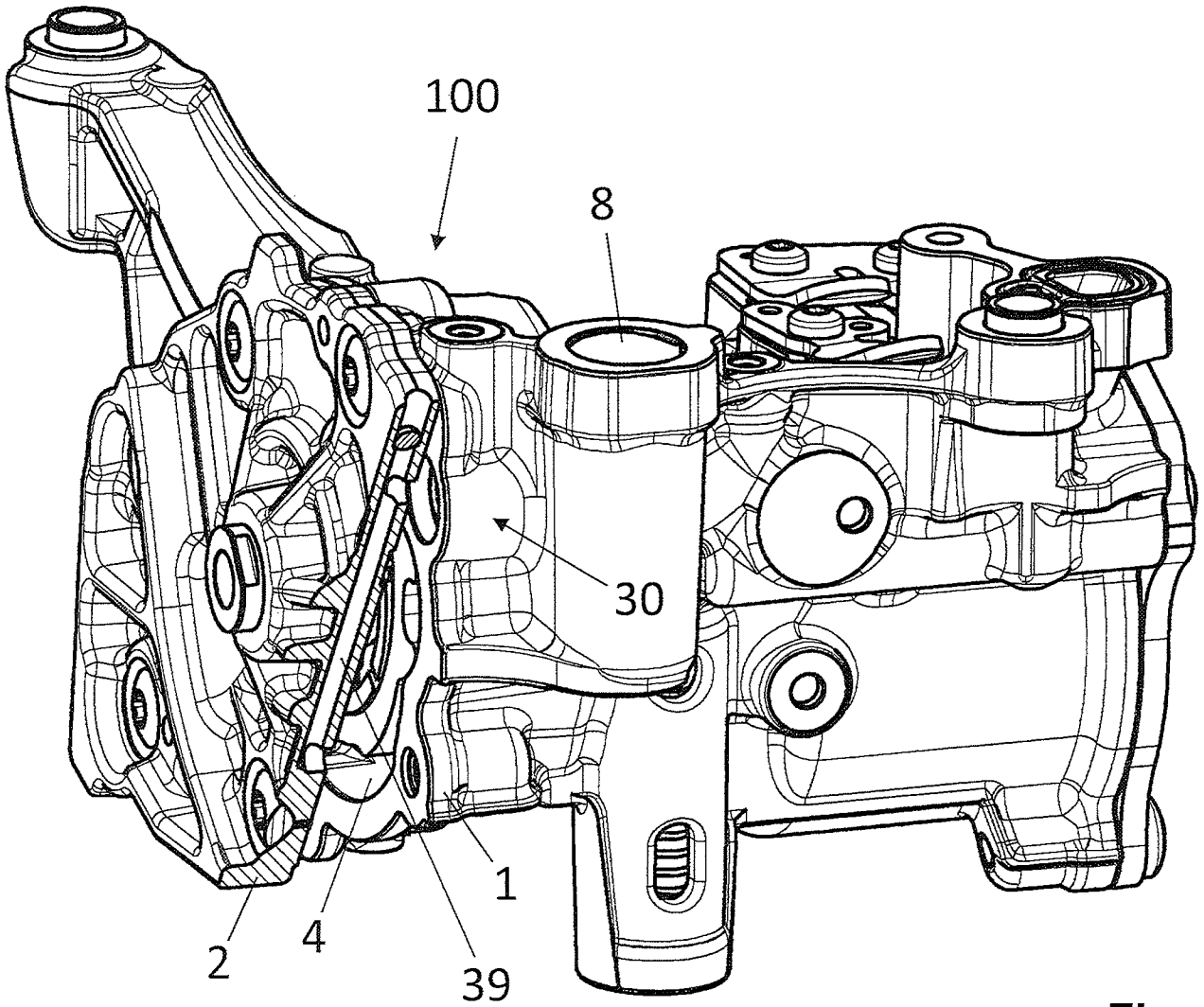
FIG. 6 the pump comprising the control valve and a relief channel of a second example embodiment.

FIG. 6 shows a pump 100 which differs from the pump 100 described above only in that the relief channel, which connects the relief port S of the control valve 30 to the suction region 4 of the pump housing 1, 2, is formed completely in the cover 2. While the relief channel 35 of the first example embodiment is formed in the joining surface 1*a* of the housing structure 1 or, in the modification indicated in FIG. 4, in the joining surface 2*a* of the cover 2 and is therefore not ultimately completed until the housing structure 1 and the cover 2 are joined, the relief channel of the second example embodiment—which, because of this difference, is referred to as the relief channel 39—extends within the cover 2. The relief channel 39 can in particular comprise a linear main channel portion which overlaps in one end region with the control valve 30 and in another end region with the suction region 4 and is connected to the valve space 31 of the control valve 30 and to the suction region 4 via short channel portions which are each formed in the cover 2 and divert or deviate from the main channel portion. An advantage of the relief channel 35 of the first example embodiment is its ease of manufacture, while an advantage of the relief channel 39 of the second example embodiment is its simplicity with respect to sealing off the internal space of the pump housing 1, 2.

In the example embodiments, the pressure port P of the control valve 30 is connected to the high-pressure side of the pump 100 within the pump housing 1, 2. The setting fluid is diverted while still in the high-pressure region of the pump housing 1, 2 and is guided to the pressure port P. The connection between the working port A and the setting pressure chamber K and/or optionally a different setting pressure chamber of the adjusting device expediently likewise extends within the pump housing 1, 2. Since the relief port S is likewise connected to the suction region 4 within the pump housing 1, 2 via the relief channel 35 or 39 which extends completely within the pump housing 1, 2, a maximum degree of integration is achieved with regard to the setting fluid. Fitting the pump is simplified, since no additional feed and/or drainage conduits have to be provided for the setting fluid and—if arranged in a delivery cycle—connected. On the other hand, it would however be conceivable to divert the setting fluid from the main flow 101 at a point upstream of the pump housing 1, 2, i.e. upstream of the pump port 8 (FIG. 3). In such modifications, the setting fluid is advantageously diverted at a point upstream of a filter arranged downstream of the pump, and before a first assembly to be supplied with the fluid, in order to guide fluid which is cleaned in the filter to the control valve 30.

The modulating valve 40 can advantageously be arranged separately from the pump housing 1, 2. Arranging it away from the pump housing 1, 2 is in particular advantageous when the modulating valve 40 is formed as an electromagnetic valve. If the modulating valve 40 is arranged away from the pump 100, then conduits leading to the modulating valve 40 for supplying power and/or transmitting control signals do not have to be screened or do not have to be as elaborately screened against the fluid to be delivered by the pump 100. This does, however, require that on the other side, the feed conduits for the control fluid first have to also be connected to the pump housing 1, 2. Since the flow cross-sections of the modulating valve 40 are typically smaller than the flow cross-sections of the control valve 30, it is particularly advantageous in relation to the control fluid if it is diverted only after it has been cleaned in a filter, in order to avoid the risk of the narrow valve cross-sections becoming blocked.

With regard to FIGS. 1 and 6, it may be noted merely for the sake of completeness that the pump 100 in the example embodiments is a constituent part of a pump unit which also comprises a vacuum pump in addition to the pump 100, and the pump 100 together with the vacuum pump forms a fitted unit. This is however extraneous to the invention.

The invention claimed is:

1. A pump which exhibits an adjustable delivery volume, the pump comprising:

(a) a pump housing, comprising: a pump port for connecting the pump to a reservoir of a fluid to be delivered; a delivery chamber which comprises a delivery chamber inlet on a low-pressure side of the pump, and a delivery chamber outlet on a high-pressure side of the pump, for a fluid; and a suction region extending from the pump port up to at least the delivery chamber inlet on the low-pressure side;

(b) a delivery member which can be moved within the delivery chamber for delivering the fluid from the low-pressure side to the high-pressure side;

(c) an adjusting device for adjusting the delivery volume of the pump;

(d) a control valve, arranged outside the suction region, comprising:

(d1) a pressure port for a setting fluid which is diverted from the fluid of the high-pressure side;

(d2) a working port for the setting fluid, which is connected to the adjusting device;

(d3) a relief port for the setting fluid;

(d4) a valve space, and a control piston which can be moved back and forth within the valve space between a first piston position and a second piston position;

(d5) and a tensing device for generating a tensing force which acts on the control piston in the direction of the second piston positions;

(e) and an additional control device for generating a control force which acts on the control piston, counter to the tensing force of the tensing device, (f) wherein the control valve:

(f1) connects the working port to the pressure port when the control piston is in the first piston position and (f2) separates the working port from the pressure port and connects the working port to the relief port when the control piston is in the second piston position, so the setting fluid can flow off into the valve space via the working port and from the valve space into the suction region via the relief port;

(g) wherein the relief port is connected to the suction region by bypassing the reservoir;

(h) wherein the relief port is connected to the suction region by a relief channel, and the relief channel feeds into the suction region at or downstream of the pump port;

(i) wherein the valve space comprises a tensing chamber for the tensing device; and (j) wherein the relief port feeds into the tensing chamber such that the tensing chamber is connected to the suction region of the pump housing in any state of the control valve.

2. The pump according to claim 1, wherein the control valve is arranged in or on the pump housing, and the relief channel extends from the relief port up to and into the suction region in and/or on the pump housing.

3. The pump according to claim 1, wherein:

the pump housing comprises a housing structure, which surrounds the delivery chamber, and a housing cover which is connected to the housing structure;

the housing cover together with the housing structure forms a joining gap extending around the delivery chamber; and the relief port is connected to the suction region by means of a relief channel which extends in and/or on the housing cover and/or in the joining gap.

4. The pump according to claim 1, wherein:

the pump housing comprises a housing structure, which surrounds the delivery chamber, and a housing cover which is connected to the housing structure;

the housing cover together with the housing structure forms a joining gap extending around the delivery chamber;

the valve space of the control valve extends in the movement direction of the control piston up to and into or through the joining gap; and the housing cover seals the valve space.

5. The pump according to claim 1, wherein the additional control device is connected to an external controller, and is configured to modulate the magnitude of the tensing force in accordance with control signals of the external controller.

6. The pump according to claim 1, wherein the control valve comprises:

a control chamber comprising an inlet for a control fluid for generating the control force by way of a control fluid pressure which acts on the control piston within the control chamber; and a modulating valve, which is arranged in a flow path of the control fluid, for changing the control fluid pressure acting in the control chamber, wherein the control fluid is diverted on the high-pressure side of the pump from the fluid delivered by the pump.

7. The pump according to claim 1, wherein:

the control piston comprises a first piston surface and a second piston surface;

a first control chamber comprising:

a first control port for a control fluid for generating a first control force by way of a first control fluid pressure which acts on the first piston surface, counter to the tensing force, within the first control chamber and a second control chamber comprising a second control port for a control fluid for generating a second control force by way of a second control fluid pressure which acts on the second piston surface, counter to the tensing force, within the second control chamber;

and the additional control device comprises a modulating valve for changing the first control fluid pressure and/or the second control fluid pressure.

8. The pump according to claim 7, wherein the first control fluid and/or the second control fluid is diverted on the high-pressure side of the pump from the fluid delivered by the pump.

9. The pump according to claim 7, wherein the modulating valve is embodied separately from the pump housing and is arranged separately from the pump housing in a delivery cycle of the pump.

10. The pump according to claim 7, wherein the control fluid is diverted on the high-pressure side at a point downstream of a filter for cleaning the fluid.

11. The pump according to claim 1, wherein:

the adjusting device comprises an adjusting member, which is assigned to the delivery member, and a setting pressure chamber;

the setting pressure chamber is connected to the working port of the control valve;

the setting fluid can be applied to the adjusting member in the setting pressure chamber in a setting direction in which it can move; and the adjusting device also comprises a spring device which exerts a spring force, counter to the pressure of the setting fluid, on the adjusting member.

12. The pump according to claim 1, wherein:

the pump is a rotary pump, and the delivery member is a delivery rotor which can be rotated about a rotary axis within the delivery chamber;

the adjusting device comprises:

an adjusting member which surrounds the delivery rotor or is arranged on an end-facing side of the delivery rotor and can be moved back and forth within the pump housing for the purpose of adjusting the delivery volume, and a setting pressure chamber which is connected to the working port of the control valve; and the setting fluid can be applied to the adjusting member in the setting pressure chamber in a setting direction in which it can move.

13. The pump according to claim 1, wherein the pump is driven in accordance with the speed of an assembly to be supplied with the fluid by the pump and is driven by the assembly in a fixed rotational speed relationship to the assembly.

14. The pump according to claim 1, wherein the fluid is a lubricating oil, and the pump is a lubricating oil pump in a lubricating oil delivery cycle of a combustion engine, and is used to supply the combustion engine with the lubricating oil.

15. The pump according to claim 1, wherein the fluid is a lubricating oil, and the pump is a lubricating oil pump in a lubricating oil delivery cycle of a drive motor of a motor vehicle, and is used to supply the drive motor with the lubricating oil.

16. The pump according to claim 1, wherein the additional control device is connected to a controller of an assembly to be supplied with the fluid by the pump, and is configured to modulate the magnitude of the tensing force in accordance with control signals of the external controller.

17. The pump according to claim 1, wherein the delivery member is a delivery rotor which can be rotated about a rotational axis within the delivery chamber.

* * * * *